US005979501A

United States Patent [19]

Kim et al.

[11] Patent Number: 5,979,501

[45] **Date of Patent: *Nov. 9, 1999**

[54] FLUID DISTRIBUTING APPARATUS FOR PISTON-TYPE HYDRAULIC MOTORS OR PUMPS

[75] Inventors: Hyeong-Yee Kim; Dong-Soo Jung; Yong-Bum Lee, all of Kyungsangnam-do, Rep. of Korea

[73] Assignee: Korea Institute of Machinery & Materials, Daejeonkwangyuk-shi, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/764,698

[22] Filed: Dec. 11, 1996

[51] Int. Cl.[6] ..... F15B 13/07

[52] U.S. Cl. ..... 137/624.13; 91/485; 137/625.21; 251/283

[58] Field of Search ..... 91/485; 137/624.13, 137/625.21; 251/283

[56] References Cited

U.S. PATENT DOCUMENTS

| | | | |
|---|---|---|---|
| 2,477,590 | 8/1949 | Ferwerda et al. | 137/624.13 X |
| 2,827,924 | 3/1958 | Towler et al. | 137/625.11 |
| 3,696,710 | 10/1972 | Ortelli | 137/625.21 X |
| 3,707,169 | 12/1972 | Friedrichs | 251/283 X |
| 4,298,318 | 11/1981 | Tsuchiya et al. | 137/625.21 X |
| 4,406,341 | 9/1983 | Bertin | 137/625.21 X |
| 5,014,748 | 5/1991 | Nogami et al. | 251/283 X |
| 5,439,356 | 8/1995 | Grahl | 91/485 X |

*Primary Examiner*—Gerald A. Michalsky
*Attorney, Agent, or Firm*—Jacobson, Price, Holman & Stern, PLLC

[57] ABSTRACT

Fluid distributing apparatus for radial piston-type hydraulic pumps or motors is disclosed. In the apparatus, a valve casing is mounted to a housing of the pump or motor. A plate valve is seated in the central portion of the valve casing and selectively rotates while maintaining a dynamic balance. A fluid distributing plate and a pressure plate are arranged in the valve casing and are brought into close contact with top and bottom surfaces of the plate valve, thereby allowing the plate valve to selectively rotate under the state of dynamic balance. A retaining ring is interposed between the fluid distributing plate and the pressure plate and surrounds the plate valve, thereby removing dynamic friction from relatively-moving portions of the plate valve, pressure plate and fluid distributing plate.

8 Claims, 8 Drawing Sheets

FLUID DISTRIBUTING APPARATUS FOR PISTON-TYPE HYDRAULIC MOTORS OR PUMPS

BACKGROUND OF THE INVENTION

1. Field of the Invention

The present invention relates, in general, to apparatus for distributing fluid in hydraulic motors or pumps of the radial piston type and, more particularly, to fluid distributing apparatus provided with a fluid distributing plate and a pressure plate, having the same construction on their opposite surfaces, a retaining ring, interposed between the two plates in order to form a gap in the junction between the plates, and a plate valve, fitted over a rotating shaft in the above, gap in order to rotate in the gap while retaining the state of dynamic balance.

2. Description of the Prior Art

As well known to those skilled in the art, hydraulic pumps are devices that are used for converting the mechanical force of a prime mover, such as an electric motor or an engine, into hydraulic force. Meanwhile, hydraulic motors are devices that are used for converting hydraulic force into mechanical force. The hydraulic pump and hydraulic motor have the same construction, while their power converting directions are opposite to each other.

In a typical hydraulic pump or motor, it is possible to increase power per unit weight by increasing both the actuating pressure and the number of revolutions (rpm). However, the typical hydraulic pump or motor of the radial piston type, which has a plate valve that inevitably causes remarkable frictional loss during a high speed operation, is problematic in that it is very difficult to increase the operational speed and to increase the power per unit weight. Another problem of the typical hydraulic pump or motor resides in that they often fail to maintain constant fluid flow rate and constant hydraulic pressure in a low speed operational mode.

SUMMARY OF THE INVENTION

It is, therefore, an object of the present invention to provide fluid distributing apparatus for hydraulic pumps or motors of the radial piston type in which the above problems can be overcome and which effectively maintains constant fluid flow rate and constant hydraulic pressure at a constant rotating speed in a low speed operational mode of the pumps or motors, and which remarkably improves operational efficiency of the pumps or motors by increasing the effective rotating speed, and which freely presets the highest operational pressure during the operation of the pumps or motors.

In order to accomplish the above object, fluid distributing apparatus for a piston-type hydraulic pump or motor, comprising: a valve casing mounted to a housing of the pump or motor; a plate valve seated in the central portion of the valve casing and selectively rotating while maintaining a dynamic balance; a fluid distributing plate and a pressure plate arranged in the valve casing and brought into close contact with top and bottom surfaces of the plate valve, thereby allowing the plate valve to selectively rotate under the state of dynamic balance; and a retaining ring interposed between the fluid distributing plate and the pressure plate and surrounding the plate valve, thereby removing dynamic friction from relatively-moving portions of the plate valve, pressure plate and fluid distributing plate.

BRIEF DESCRIPTION OF THE DRAWINGS

The above and other objects, features and other advantages of the present invention will be more clearly understood from the following detailed description taken in conjunction with the accompanying drawings, in which:

FIGS. 1A to 1C are views showing the construction and configuration of a plate valve used in the fluid distributing apparatus in accordance with the primary embodiment of the present invention, in which:

FIG. 1A is a plan view of the valve;

FIG. 1B is a sectional view of the valve taken along the line I—I of FIG. 1A; and FIG. 1C is a bottom view of the valve;

FIGS. 2A and 2B are views showing the construction and configuration of a pressure plate mounted to the bottom of the above plate valve, in which:

FIG. 2A is a plan view of the pressure plate; and

FIG. 2B is a sectional view of the pressure plate taken along the line II—II of FIG. 2A;

FIGS. 3A and 3B are views showing the construction and configuration of a retaining ring used in the fluid distributing apparatus of this invention, in which:

FIG. 3A is a plan view of the retaining ring; and

FIG. 3B is a sectional view of the retaining ring taken along the line III—III of FIG. 3A;

FIGS. 5A to 5C are views showing the construction and configuration of a plate valve used in the fluid distributing apparatus in accordance with a second embodiment of the present invention, in which:

FIG. 5A is a plan view of the valve;

FIG. 5B is a sectional view of the valve taken along the line V—V of FIG. 5A; and FIG. 5C is a bottom view of the valve;

FIGS. 6A and 6B are views showing the construction and configuration of a pressure plate mounted to the bottom of the plate valve of FIGS. 5A to 5C, in which:

FIG. 6A is a plan view of the pressure plate; and

FIG. 6B is a sectional view of the pressure plate taken along the line VI—VI of FIG. 6A;

DESCRIPTION OF THE PREFERRED EMBODIMENTS

Figure 1A:
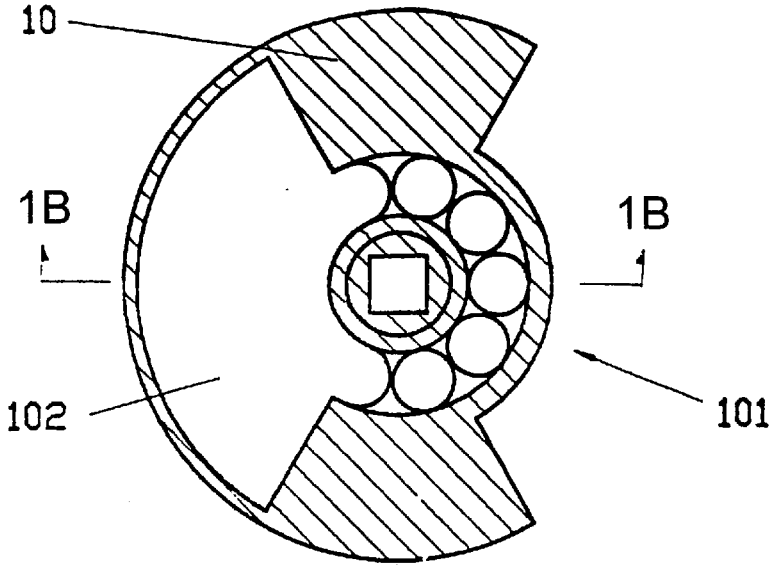
Figure 1B:
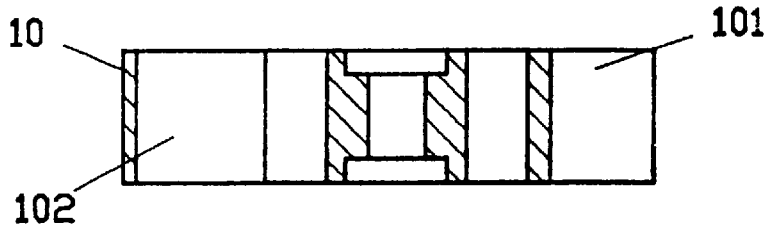
Figure 1C:
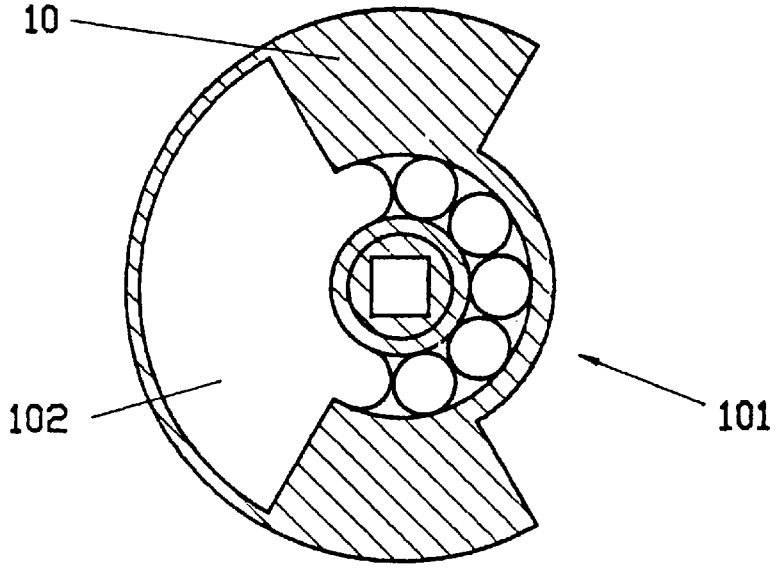
Figure 2A:
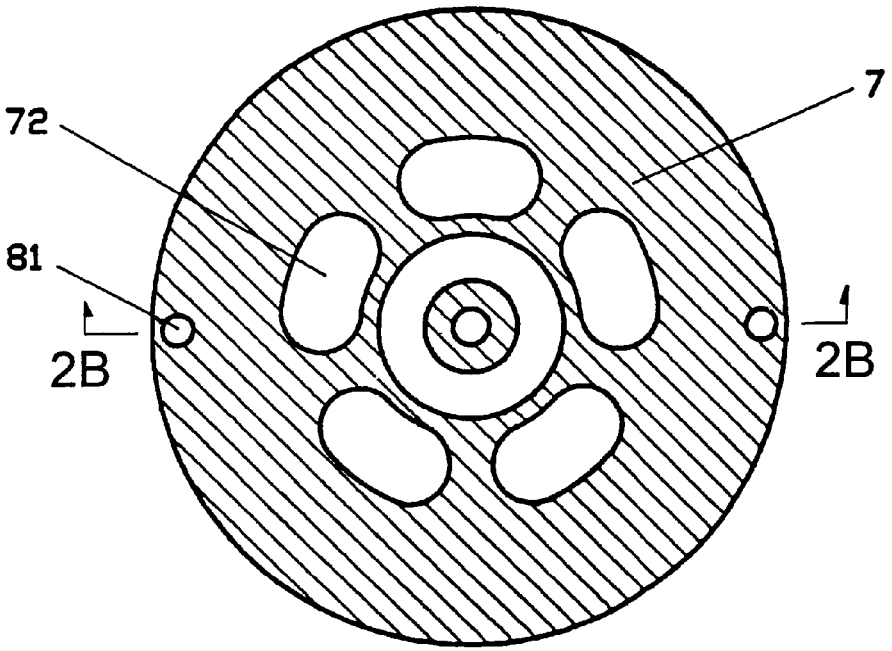
Figure 2B:
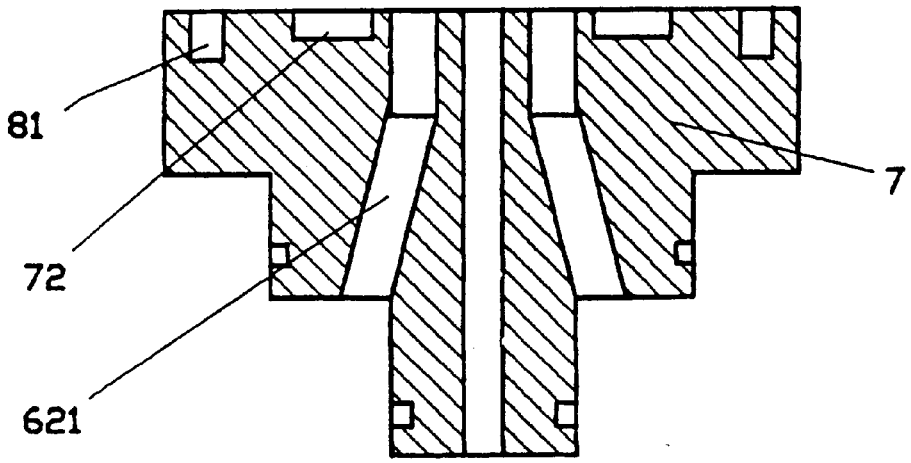
Figure 3A:
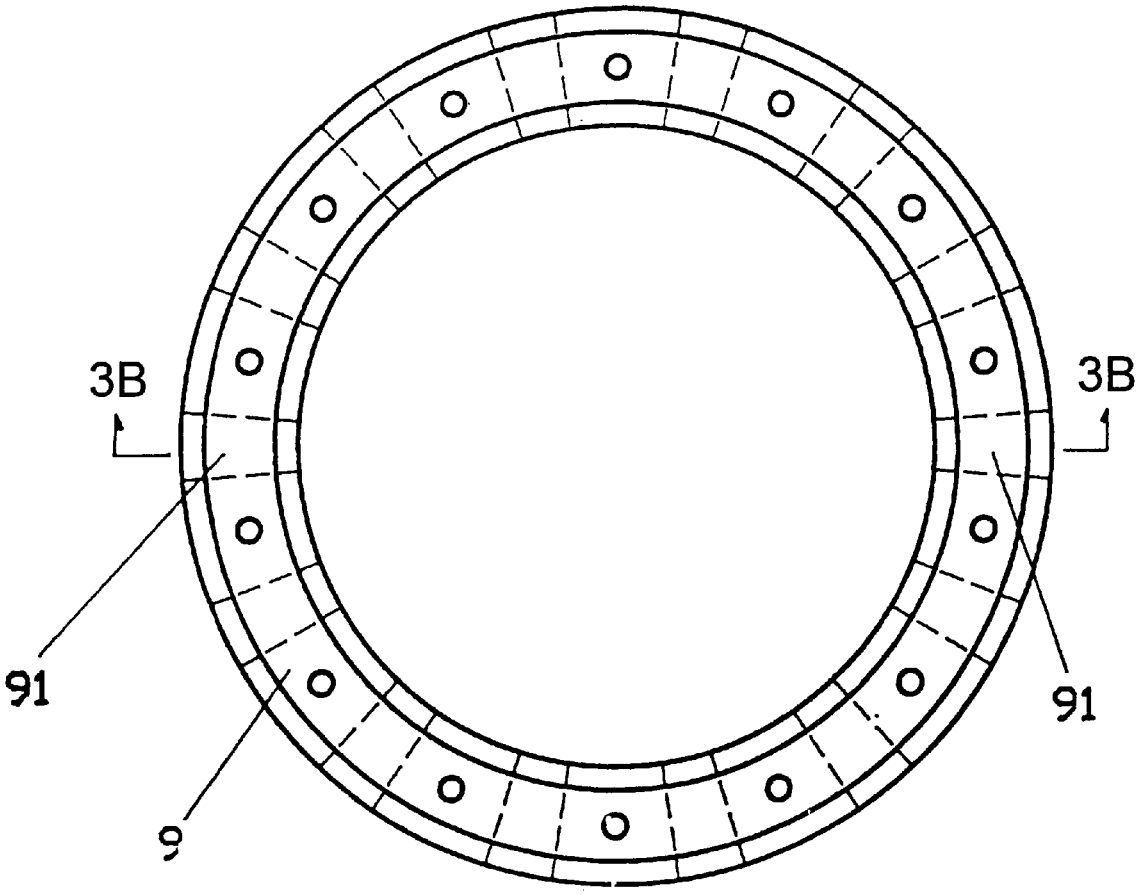
Figure 3B:
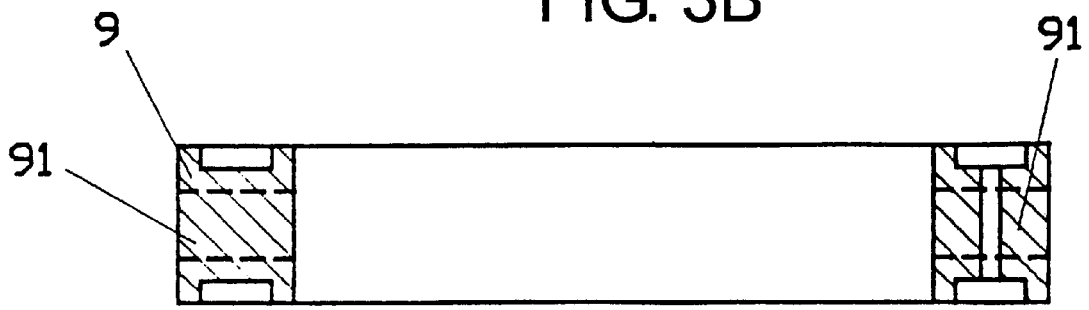
Figure 4:
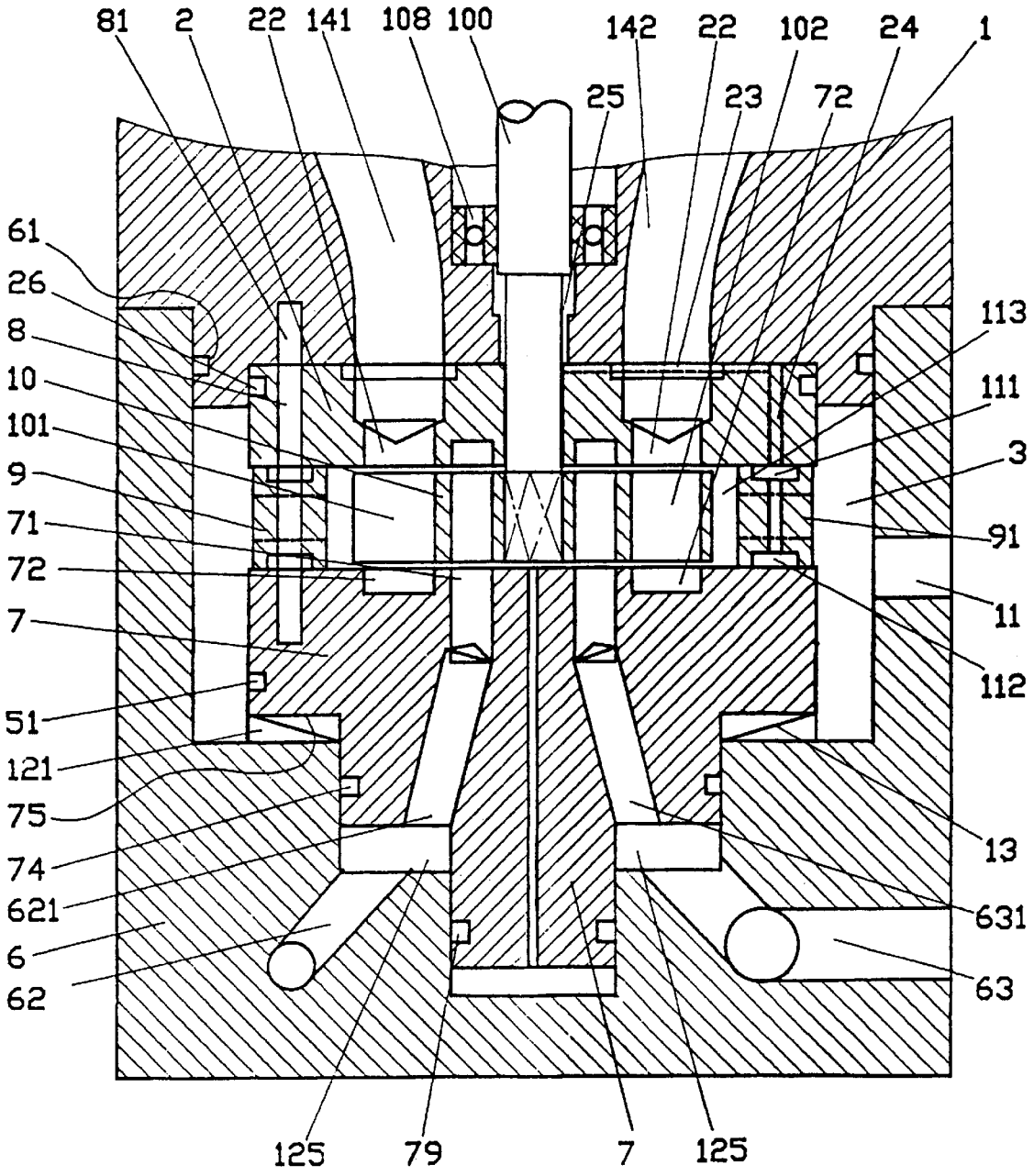
FIG. 4 is a sectional view showing the construction of the fluid distributing apparatus formed by assembling the above plate valve, fluid distributing plate, pressure plate and retaining ring into a single body.

FIG. 1A is a plan view of a plate valve used in the fluid distributing apparatus in accordance with the primary embodiment of this invention. FIG. 1B is a sectional view of the valve taken along the line I—I of FIG. 1A. FIG. 1C is a bottom view of the valve of FIG. 1A. FIG. 2A is a plan view of a pressure plate mounted to the bottom of the above plate valve. FIG. 2B is a sectional view of the pressure plate taken along the line II—II of FIG. 2A. FIG. 3A is a plan view of a retaining ring used in the fluid distributing apparatus of this invention. FIG. 3B is a sectional view of the retaining ring taken along the line III—III of FIG. 3A. FIG. 4 is a sectional view of the fluid distributing apparatus formed by assembling the above plate valve, fluid distributing plate, pressure plate and retaining ring into a single body.

The fluid distributing apparatus according to this invention may be used in either a radial piston-type hydraulic pump or motor without affecting the functioning of this invention. In the preferred embodiment, the fluid distributing apparatus is used in a hydraulic motor for ease of description.

As shown in FIG. 4, the fluid distributing apparatus of this invention includes a valve casing 6 which is mounted to the lower end of a hydraulic motor's housing 1, with a seal 61 being interposed in the junction between the housing 1 and casing 6. The casing 6 has a cylindrical opening which receives a fluid distributing plate 2, a plate valve 10 and a pressure plate 7. A first port 11 and two fluid passages 62 and 63 are formed on the wall of the casing 6.

The fluid distributing plate 2 is seated in the depressed lower end of the motor housing 1, with a seal 26 being interposed in the junction between the housing 1 and plate 2. The plate 2 has a leakage port 24 and a return passage 23, which return leaked fluid. Five timing ports 22 are formed on the plate 2 at positions corresponding to the respective five balance ports 72 of the pressure plate 7. The above plate 2 guides the fluid in the junction between the plate valve 10 and the motor housing 1.

In the apparatus, the plate valve 10 must maintain a dynamic balance state. In order to maintain the dynamic balance state, the top and bottom surfaces of the valve 10 are completely symmetric to each other. In addition, the part around a first valve port 101 is completely removed from the valve 10, thereby reducing turning moment of inertia and minimizing the amount of leaked fluid. The above valve 10 is fitted over a rotating shaft 100 of the motor housing 1 in the space defined between the fluid distributing plate 2, pressure plate 7 and retaining ring 9, so that the valve 10 can be rotated in the above space. In the above valve 10, the center of action of the hydraulic pressure, caused by the pressurized fluid applied to the top and bottom surfaces of the valve, is disposed on the geometric center of the valve 10. The valve 10 is rapidly started and is quickly converted between normal and reverse-directional operating modes.

The above valve 10 performs a valving operation while the fluid is supplied or drained to or from the motor under by the linear reciprocating motion of a piston inside a cylinder. That is, the valve 10 guides the fluid between the regularly-spaced ring holes 91 of the retaining ring 9 and the timing ports 22 of the fluid distributing plate 2.

The valve 10 is machined in order to form the top and bottom surfaces of the same configuration. Such a symmetric configuration of the valve 10 is a very important factor which allows the valve 10 to rotate in the gap between the pressure plate 7 and the fluid distributing plate 2 while maintaining the dynamic balance.

Meanwhile, the pressure plate 7 is seated in the valve casing 6, with a fluid passage 125 being formed between the plate 7 and the casing 6. A seal 74 is interposed in the junction between the plate 7 and casing 6. A port 71 is formed on the pressure plate 7 at a position corresponding to the plate valve 10. The pressure plate 7 also has an annular fluid passage 621 which connects the pressure plate port 71 to the valve casing 6. On the pressure plate 7, the five balance ports 72 are formed on the pressure plate 7 at positions corresponding to the five timing ports 22 of the fluid distributing plate 2. The pressure plate 7 is assembled with the fluid distributing plate 2, with the balance ports 72 being aligned with the respective timing ports 22. A dish-shaped spring 13 is seated in a spring space 121 which is formed between the annular wall 75 of the pressure plate 7 and the interior wall of the valve casing 6. The spring 13 in the spring space 121 strongly biases the pressure plate 7 toward the motor housing 1.

In the above apparatus, the maximum operational pressure can be freely selected by appropriately selecting elasticity of the spring 13 and by making the hydraulic pressure, which is applied from the fluid passage 125 to the plate valve 10, higher than the hydraulic pressure applied from the plate valve 10 to the pressure plate 7.

When the hydraulic pressure applied to the pressure plate 7 is higher than the elasticity of the spring 13, the retaining ring 9 is separated from the fluid distributing plate 2, so that the fluid is leaked from the fluid passages through the groove 111, leakage port 24 and return passage 23.

In the fluid distributing plate 2, the five timing ports 22 have the same configuration and size as those of the five balance ports 72 of the pressure plate 7. The above plate 2 guides the fluid between the plate valve 10 and the fluid passages formed in the motor housing 1.

When the retaining ring 9 is slightly thicker than the plate valve 10 and has the regularly-spaced ring holes 91 which pass the fluid. The top and bottom surfaces of the ring 9 are provided with a plurality of grooves 111 and 112, respectively. Therefore, the above ring 9 removes dynamic friction from the relatively-moving portions of the plate valve 10, pressure plate 7 and fluid distributing plate 2 when the plate valve 10 rotates in the gap between the two plates 2 and 7.

The retaining ring 9 also has two pin holes 81, while the edges of the pressure plate 7, fluid distributing plate 2 and motor housing 1 are provided with axial pin holes which communicate with the pin holes 81 of the ring 9. A plurality of pins 8 are inserted in the aligned pin holes of the ring 9, plates 2 and 7 and motor housing 1, so that the ring 9, plates 2 and 7 and motor housing 1 are precisely assembled together in their places.

In the motor housing 1, the rotating shaft 100 is coupled to the piston shaft of the hydraulic motor and is rotatably held by a bearing 108, and transmits the rotating force to the plate valve 10. The rotating shaft 100 also synchronizes the opening cycle of the timing ports 22 with the reciprocation cycle of the piston which is connected to the piston shaft of the motor in order to supply and drain the fluid.

A gap 25 is formed between the rotating shaft 100, motor housing 1 and fluid distributing plate 2, thus allowing the fluid, which passes through the leakage port 24 and return passage 23, to return into the motor housing 1.

Figure 5A:
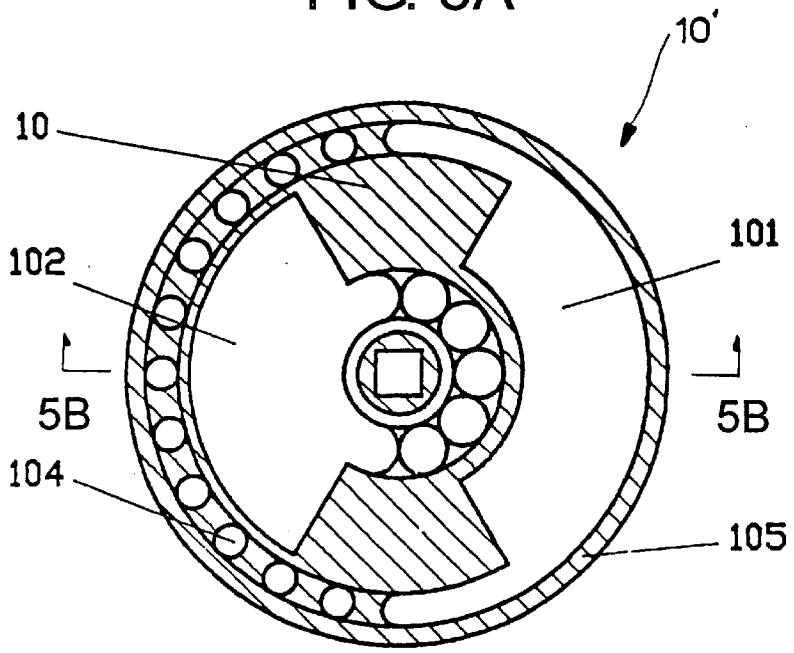
Figure 5B:
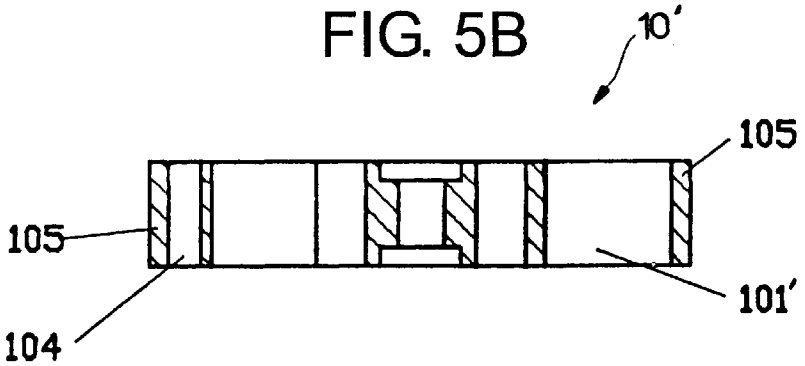
Figure 5C:
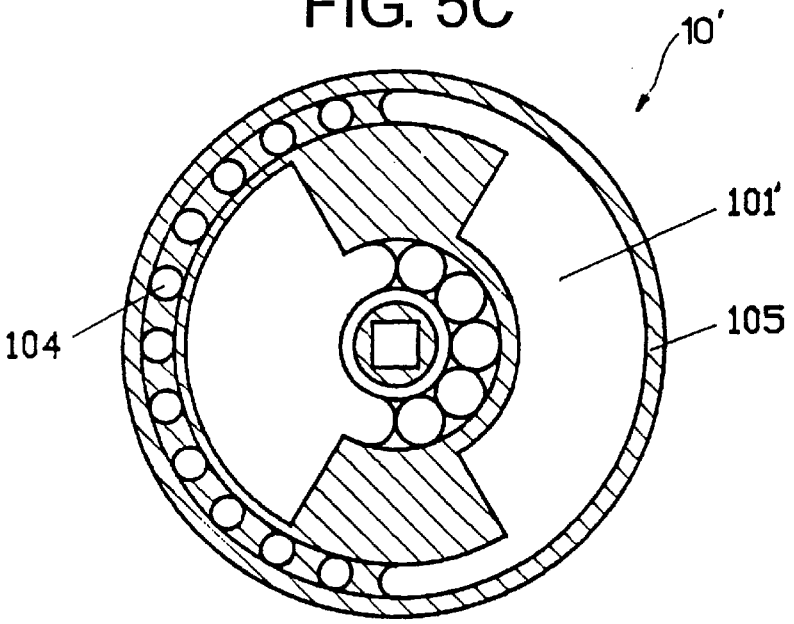
Figure 6A:
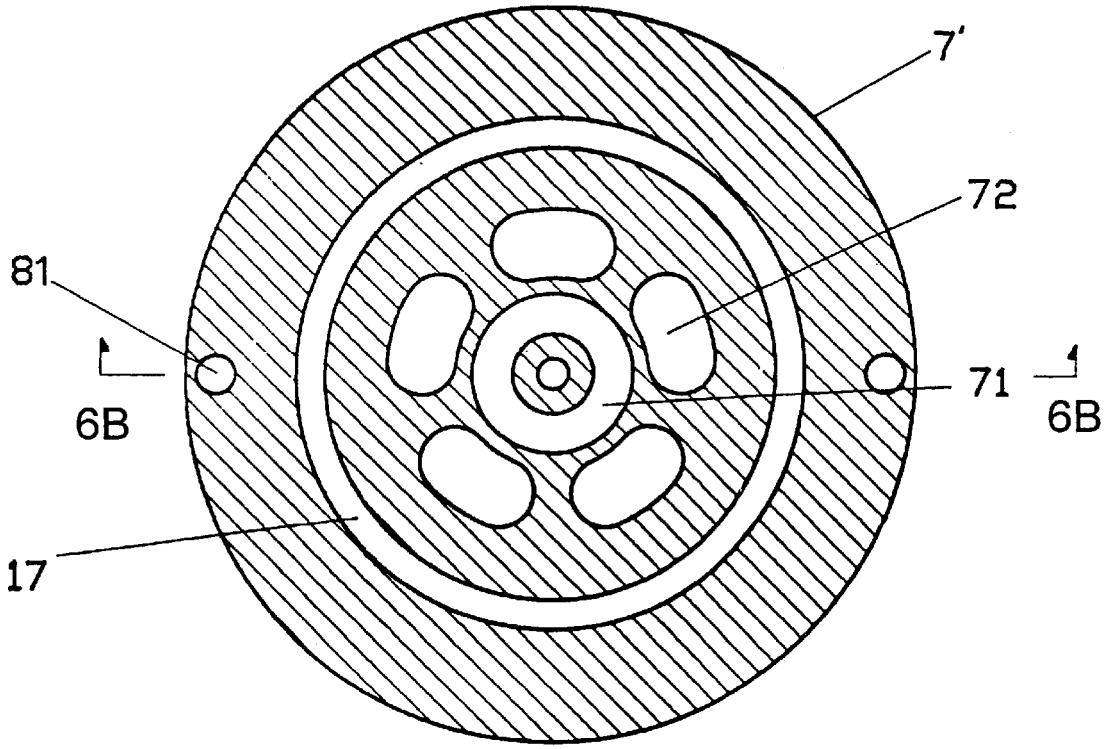
Figure 6B:
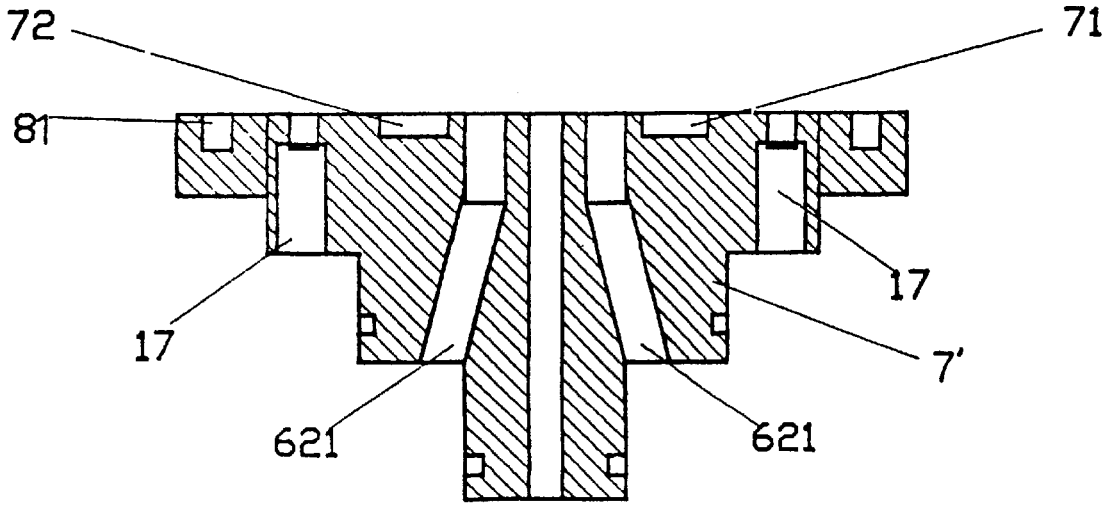

FIG. 5A is a plan view of a plate valve used in the fluid distributing apparatus in accordance with a second embodiment of this invention. FIG. 5B is a sectional view of the valve taken along the line V—V of FIG. 5A. FIG. 5C is a bottom view of the valve. FIG. 6A is a plan view of a pressure plate mounted to the bottom of the plate valve of FIG. 5A. FIG. 6B is a sectional view of the pressure plate taken along the line VI—VI of FIG. 6A.

In the second embodiment, each of the pressure plate 7' and plate valve 10' has the construction and operational effect similar to those described for the primary embodiment.

Of the two fluid passages provided in the apparatus according to the primary embodiment, one passage 621 is formed on the pressure plate 7, while the other passage is formed by the ring hole 92 of the retaining ring 9.

Meanwhile, the fluid distributing apparatus according to the second embodiment has not only the fluid passage 621 formed on the pressure plate 7', it also has a second port 17 which passes supplied or drained fluid under pressure as shown in FIGS. 6A and 6B.

In the second embodiment, the plate valve 10' has the same operational effect as that described for the plate valve 10 of the primary embodiment. However, the plate valve 10' is slightly larger than the plate valve 10 of the primary embodiment. The above valve 10' has a plurality of through holes 104 at positions corresponding to the second port 17 of the pressure plate 7'. The valve 10' also has an annular member 105 which surrounds a valve port 101'. The above valve port 101' has the same construction and operational effect as those of the valve port 101 included in the plate valve 10 according to the primary embodiment.

Hereinbelow, the operational effect of the fluid distributing apparatus of this invention will be described with reference to FIGS. 7 and 8.

Figure 7:
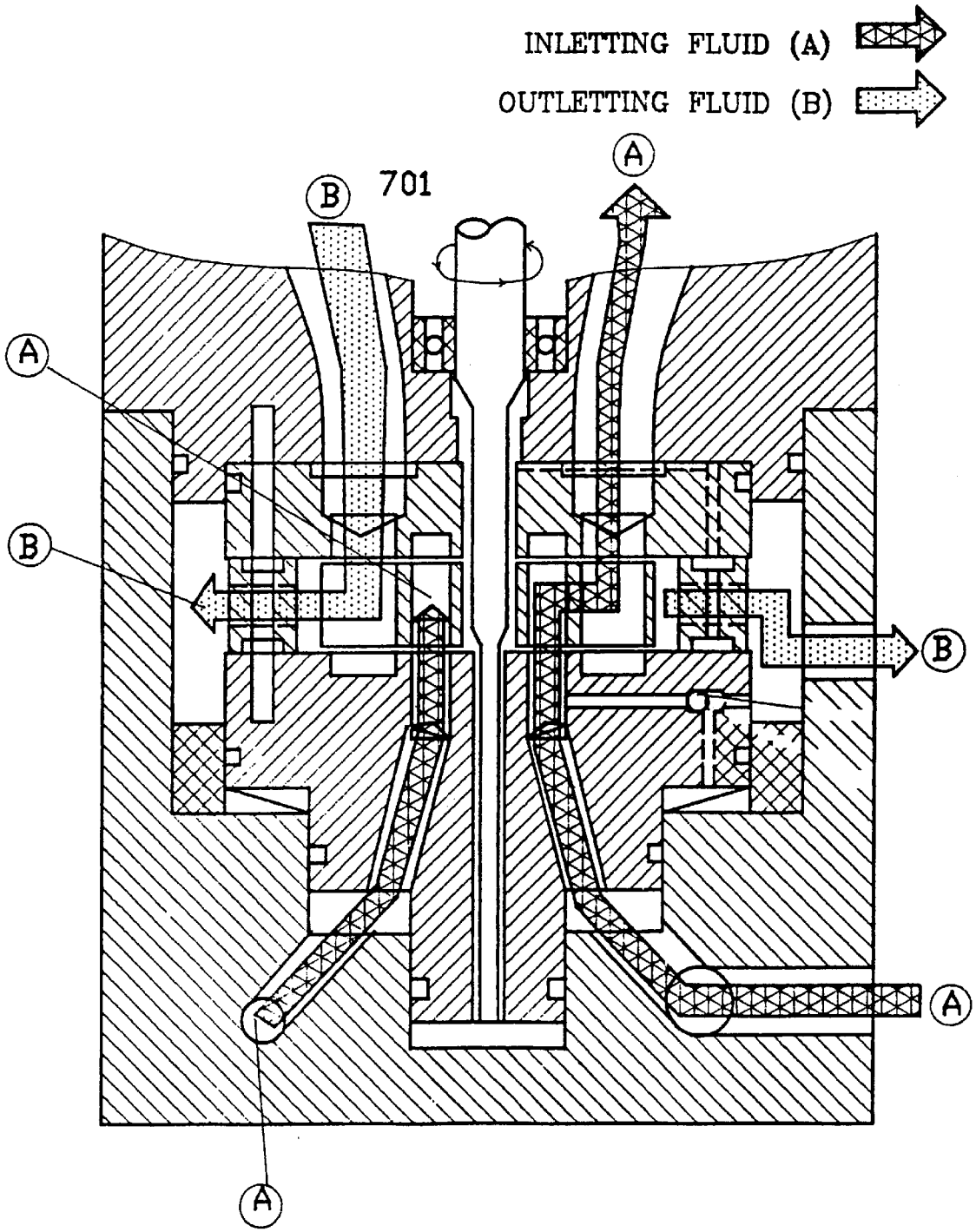
FIG. 7 is a sectional view of the fluid distributing apparatus of FIG. 4, showing the flow direction of fluid in the apparatus while a rotating shaft is rotated in the normal direction.

FIG. 7 is a sectional view of the fluid distributing apparatus of this invention, showing the flow direction of fluid in the apparatus while the rotating shaft is rotated in the normal direction. FIG. 8 is a sectional view of the fluid distributing apparatus, showing the flow direction of fluid in the apparatus while the rotating shaft is rotated in the reverse direction.

Figure 8:
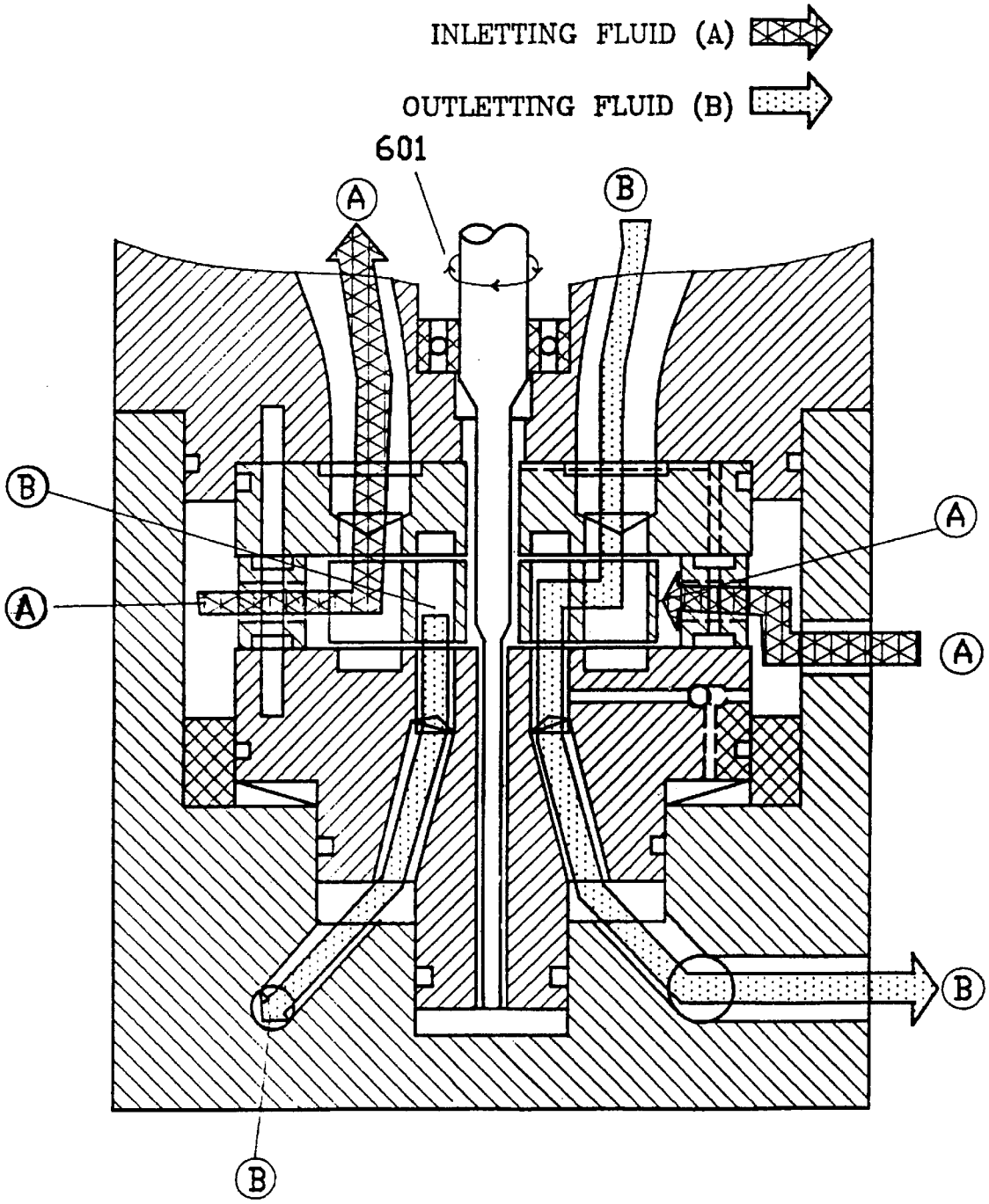
FIG. 8 is a sectional view of the fluid distributing apparatus of FIG. 4, showing the flow direction of fluid in the apparatus while the rotating shaft is rotated in the reverse direction.

When the rotating shaft 100 is rotated in the reverse direction, pressurized fluid is inlet into the apparatus through the port 11 and reaches the cylindrical chamber 3 as shown in the arrows A of FIG. 8.

The pressurized fluid inside the cylindrical chamber 3 in turn passes through the ring hole 91 of the retaining ring 9 thus reaching the plate valve chamber 113.

In the above state, the plate valve 10 is rotated in the direction as shown in the arrow 601 of FIG. 8. The pressurized fluid inside the plate valve chamber 113 thus passes through the valve port 101 of the plate valve 10 and passes through the timing ports 22 of the fluid distributing plate 2 thereby reaching the passage 141 of the motor housing 1.

The pressurized fluid inside the passage 141 of the housing 1 in turn flows into the cylinder of the hydraulic motor, thereby reciprocating the piston (not shown) inside the cylinder. The reciprocating motion of the piston generates hydraulic force of the motor.

The pressurized fluid loses its pressure after moving the piston and flows through another passage 142 of the motor housing 1 as shown in the arrow B of FIG. 8 thereby reaching the timing ports 22 of the fluid distributing plate 2. The fluid in turn flows to the second valve port 102 of the plate valve 10 and reaches the pressure plate port 71. Thereafter, the fluid passes through the first and second passages 621 and 631 of the pressure plate 7 and passes through the first and second passages 62 and 63 of the valve casing 6 prior to being drained outside the apparatus.

When the rotating shaft 100 is rotated in the normal direction, fluid which loses pressure is distributed from the cylinder by the piston and flows through the passage 141 of the motor housing 1. The fluid in turn passes through the timing ports 22 of the fluid distributing plate 2 thereby reaching the plate valve chamber 113 as shown in the arrow B of FIG. 7. In the above state, the plate valve 10 is rotated in the direction as shown in the arrow 701 of FIG. 7. The fluid inside the plate valve chamber 113 thus passes through the pressure plate port of the plate valve 10 and flows through the ring hole 91 of the retaining ring 9 thereby reaching the cylindrical chamber 3. The fluid inside the chamber 3 in turn passes through the port 11 of the motor housing 1 thus being drained outside the apparatus.

Meanwhile, pressurized fluid is inlet into the apparatus through the first and second passages 62 and 63 of the valve casing 6 and in turn flows through the first and second passages 621 and 631 of the pressure plate 7 thereby reaching the plate valve 10 as shown in the arrows A of FIG. 7. Thereafter, the pressurized fluid flows into the cylinder of the motor through the second cylinder passage 142.

As described above, the present invention provides fluid distributing apparatus for hydraulic pumps or motors. In a low speed operational mode of a hydraulic pump or motor of the radial piston type, the apparatus of this invention causes the pump or motor to effectively maintain constant fluid flow rate and constant hydraulic pressure at a constant rotating speed while simultaneously maintaining the operational efficiency of not lower than the conventionally-expected efficiency. The apparatus also remarkably improves operational efficiency of the pump or motor by increasing the effective maximum rotating speed of the pump or motor, and freely presets the highest operational pressure during the operation of the pump or motor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. Fluid distributing apparatus for a piston-type hydraulic pump/motor, comprising:

a valve casing directly mounted to a housing, said valve casing having a cylindrical opening at a central portion;

a plate valve seated in the opening of said valve casing and selectively rotating while maintaining a dynamic balance;

a fluid distributing plate and a pressure plate arranged in the opening of said valve casing and brought into close contact with top and bottom surfaces of said plate valve, thereby allowing the plate valve to selectively rotate under the state of dynamic balance; and a retaining ring interposed between said fluid distributing plate and said pressure plate and surrounding the plate valve, thereby removing dynamic friction from relatively-moving portions of said plate valve, pressure plate and fluid distributing plate.

2. The fluid distributing apparatus according to claim 1, wherein the top and bottom surfaces of said plate valve have completely symmetrical construction thereby maintaining the dynamic balance in a gap between said fluid distributing plate and said pressure plate.

3. The fluid distributing apparatus according to claim 1, wherein said retaining ring is slightly thicker than said plate valve and thereby removing dynamic friction from the relatively-moving portions of the plate valve, pressure plate and fluid distributing plate.

4. The fluid distributing apparatus according to claim 1, wherein a fluid passage is annularly formed on said pressure plate thereby reducing the volume and simplifying the construction of said pressure plate.

5. The fluid distributing apparatus according to claim 1, wherein a part around a first valve port is completely removed from said plate valve, thereby reducing turning moment of inertia and minimizing the amount of leaked fluid.

6. The fluid distributing apparatus according to claim 1, wherein said fluid distributing plate and said pressure plate have five balance ports and five timing ports on corresponding positions respectively, so that the pressure plate and fluid distributing plate have same construction and size on their contact surfaces where they are brought into contact with the plate valve.

7. The fluid distributing apparatus according to claim 1, wherein a dish-shaped spring is seated between said pressure plate and said valve casing in order to bias the pressure plate toward said housing of the pump and motor, so that a maximum operational pressure is predetermined by a difference between a hydraulic pressure applied to one surface of said pressure plate and the sum of the biasing force of said dish-shaped spring and a hydraulic pressure applied to the other surface of the pressure plate.

8. A fluid distributing apparatus for a piston-type hydraulic pump/motor, comprising:

a valve casing directly mounted to a housing, said valve casing having a cylindrical opening at a certain portion;

a plate valve seated in the opening of said valve casing and selectively rotating while maintaining a dynamic balance;

a fluid distributing plate arranged on one side of said plate valve;

a pressure plate arranged on the opposite side of the plate valve; and a retaining ring interposed between said fluid distributing plate and said pressure plate to provide a space in which said plate valve is placed to rotate without dynamic friction, wherein top and bottom surfaces of said plate valve have symmetrically formed shapes; said fluid distributing plate and said pressure plate have timing ports and balance ports, respectively, which are identically formed on their corresponding parts facing each other; and said retaining ring has grooves and ring holes communicating with fluid passages in the fluid distributing plate and a cylindrical chamber in said valve casing.

* * * * *